US006313807B1

(12) United States Patent
Kolak

(10) Patent No.: US 6,313,807 B1
(45) Date of Patent: Nov. 6, 2001

(54) SLOT FED SWITCH BEAM PATCH ANTENNA

(75) Inventor: Frank Stan Kolak, Billerica, MA (US)

(73) Assignee: Tyco Electronics Corporation, Wilmington, DE (US)

( * ) Notice: Subject to any disclaimer, the term of this patent is extended or adjusted under 35 U.S.C. 154(b) by 0 days.

(21) Appl. No.: 09/691,815

(22) Filed: Oct. 19, 2000

(51) Int. Cl.[7] ..... H01Q 13/10

(52) U.S. Cl. ..... 343/771; 343/700 MS; 343/725

(58) Field of Search ..... 343/700 MS, 767, 343/768, 769, 770, 771, 725, 829, 846, 438; H01Q 21/00, 13/10

(56) References Cited

U.S. PATENT DOCUMENTS 4,755,821 * 7/1988 Itoh et al. ..... 343/700 MS
4,843,400 * 6/1989 Tsao et al. ..... 343/700 MS
4,864,314 * 9/1989 Bond ..... 343/700 MS
5,337,058 * 8/1994 Cross ..... 343/753
5,394,163 * 2/1995 Bullen et al. ..... 343/771
5,831,581 * 11/1998 Keough ..... 343/725

* cited by examiner

*Primary Examiner*—Tho Phan

(57) ABSTRACT

An array antenna includes a patch arrayed on a metal backing plate and a plurality of inputs connected to the patch so as to radiate and receive an electromagnetic wave via the patch. The array antenna includes a transmitting/receiving circuit for feeding or receiving signals at a specific frequency to or from the array antenna. A waveguide divided into sections is provided to feed the electromagnetic wave to the radiating antenna. Each waveguide section produces a specific phase difference along the array antenna which accumulates and causes the electromagnetic wave to focus at a particular angle. Each waveguide section therefore produces a wave focused at a different angle, allowing the antenna to generate a plurality of focused waves.

8 Claims, 3 Drawing Sheets

SLOT FED SWITCH BEAM PATCH ANTENNA

FIELD OF THE INVENTION

This invention generally relates to the field of automotive radar. More particularly, it relates to the transmission and reception of radar beams in automotive radar applications with an antenna which is smaller and more compact than that found in the prior art. Moreover the antenna of the present invention has inputs for a plurality of directed antenna beam inputs.

BACKGROUND OF THE INVENTION

Millimeter wave automotive radar of various types have been developed and utilized in different forms in the prior art. Recently, there has been considerable development in the application of millimeter wave radar to the automotive application known as Adaptive Cruise Control (ACC). ACC uses forward looking sensors mounted on an automobile to collect information about objects in the roadway ahead of the automobile, and transmit the information to the driver. Examples of information collected are data on velocity, direction and distance of objects within the detection range of the sensors.

It is common in prior art applications of millimeter wave radar to ACC, to employ a beam or a plurality of beams to scan an azimuthal field of view ahead of the vehicle on which the radar is mounted.

Scanning the azimuthal field of view using millimeter wave radar has been performed by both mechanical and electrical means in the prior art. Mechanical scanning radar however necessitates unduly large and precise structures to accommodate the mechanical means to accomplish a scan of an azimuthal field of view.

Electronic beam switching radar performs a scan of an azimuthal field of view by electronically varying the direction of radiated beams from an antenna array. By varying the directionality of the radiated beam by electronic means, electronic beam switching radar eliminates the mechanical elements needed to perform the task of scanning an azimuthal field of view and thereby reduces the size, complexity and cost of the structure needed to house the ACC radar.

The reduction in size of an ACC radar such as that provided in the electronic beam switching context is desirable for several reasons. Space is at a premium in the body structures of automobiles and the smaller a device is, the easier it is to place unobtrusively within, or on the structure of the vehicle. Moreover, a reduction in size and complexity of a device often renders the device less costly to produce in large numbers.

Among various examples of electronic beam switching radar in the prior art, a self phased (or self steered) antenna array has been used to change the direction of beams radiated from the array. The change in direction of radiated beams is accomplished by distinct phase differences between adjacent antenna elements. The radiating elements of the antenna can be used as a phased array antenna by simply setting a phase difference between antenna elements.

Varying the directivity in this manner however, can prove to be problematic depending on, for example, the size and distance (from the antenna) of objects to be detected. Moreover, unwanted radiation from the feeders to the antenna array, which are typically formed on the same planar surface, can lead to the deterioration of the directivities of the steered beams and worsened sidelobe levels

SUMMARY OF THE INVENTION

These and other drawbacks of the prior art are addressed by the present invention. The present invention propose a novel, simplified approach to the production of a plurality of directional beams from an antenna assembly.

In a preferred embodiment of the present invention, there is provided a patch antenna, which comprises a partitioned waveguide and a metal backing plate. The antenna has inputs for each of a plurality of desired directed antenna beams. Each beam is fed through slots in a partitioned waveguide that are spaced to create a specific guide wavelength. For each desired directional beam, a corresponding portion of the partitioned waveguide produces a desired phase difference along the patch antenna array, which accumulates and allows the beam to focus at the appropriate angle. Thus, for example, one input to the antenna would feed a beam at +4 degrees, one at 0 degrees and one at −4 degrees.

The configuration of the antenna elements are such that the antenna is substantially planar and without appreciable thickness. The relative simplicity and compactness of the planar design results in much lower production costs, and ease of high volume manufacture.

Therefore, a primary advantage of the present invention is to provide an array antenna capable of varying its directionality as desired.

Another advantage of the present invention is that it provides a simpler, smaller and thereby less expensive, antenna device that varies direction through a common linear patch antenna and produces a plurality of directed beams.

Yet another advantage of the present invention is that it provides an antenna that operates within the frequency range of 75 to 79 GHz.

These features and advantages of the present invention will become manifest to those versed in the art upon reference to the detailed description and accompanying drawings in which preferred structural embodiments incorporating the principles of the present invention are shown by way of illustrative examples.

BRIEF DESCRIPTION OF THE DRAWINGS

A preferred embodiment of the present invention will be described hereinbelow, by way of example only, with reference to the accompanying drawings, in which:

FIG. 2 is a schematic sectional view showing a waveguide in accordance with the present invention and FIG. 3 is a plot of Gain vs. Azimuth of a directed beam generated according to the method of the present invention.

DETAILED DESCRIPTION

The following description is merely exemplary in nature and is in no way intended to limit the invention or its application or uses.

Figure 1:
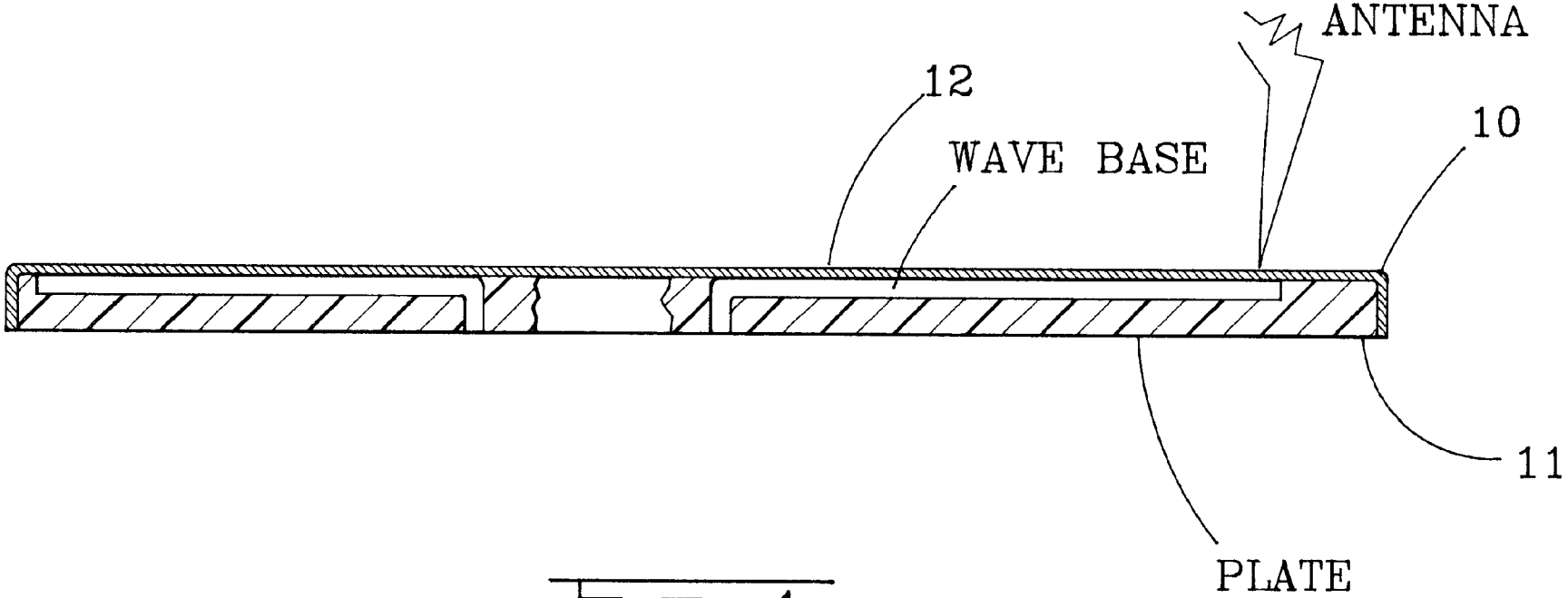
FIG. 1 is a schematic sectional view of an antenna device comprising an array antenna according to the present invention.

FIG. 1. Shows an antenna device according to a preferred embodiment of the present invention, which comprises an array antenna as will be described in detail below. FIG. 1 is a sectional view of an antenna device 10, comprising a backing plate 11, supporting a waveguide 12 and patch antenna 13.

Figure 2:
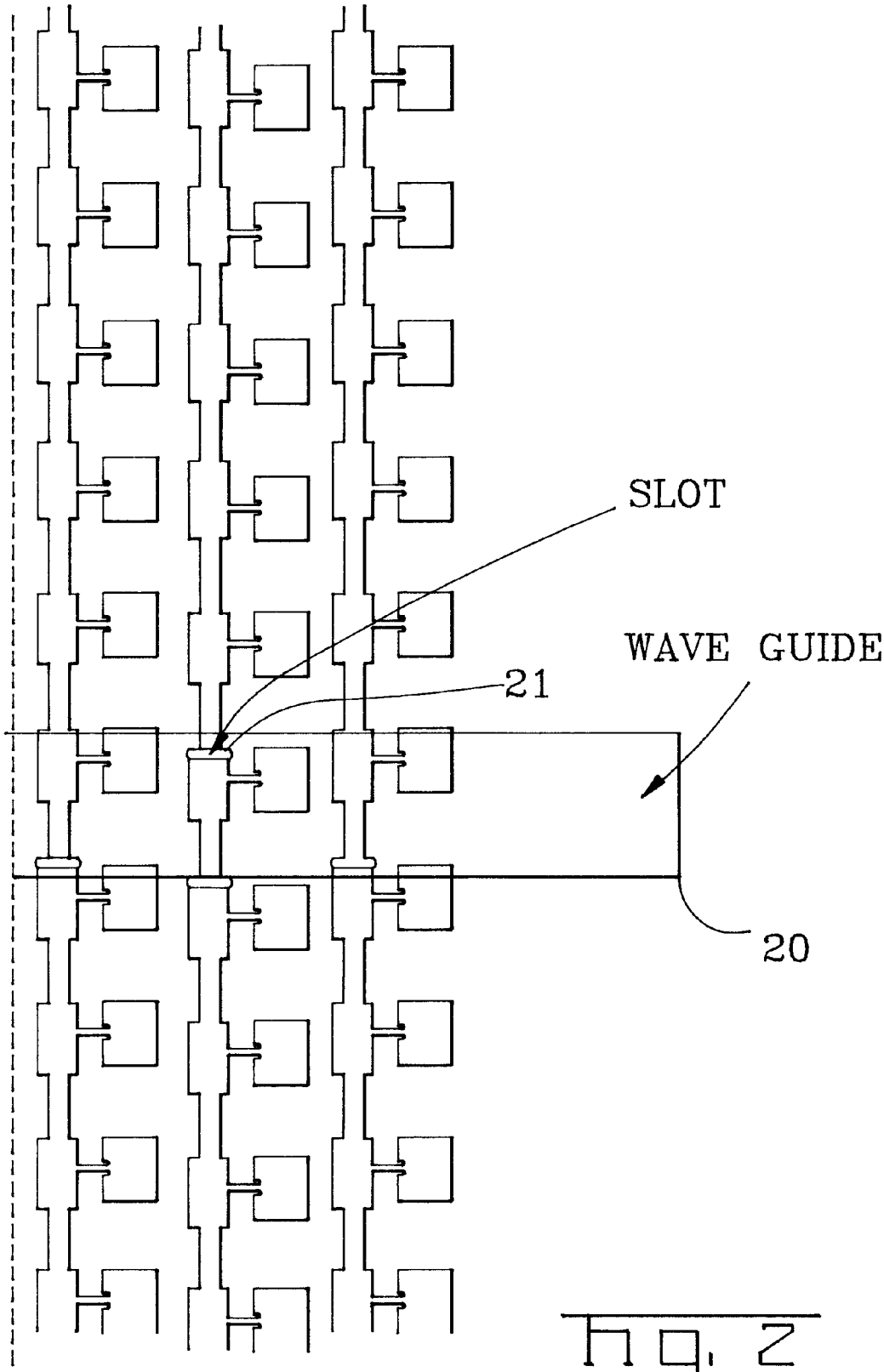
Figure 7:
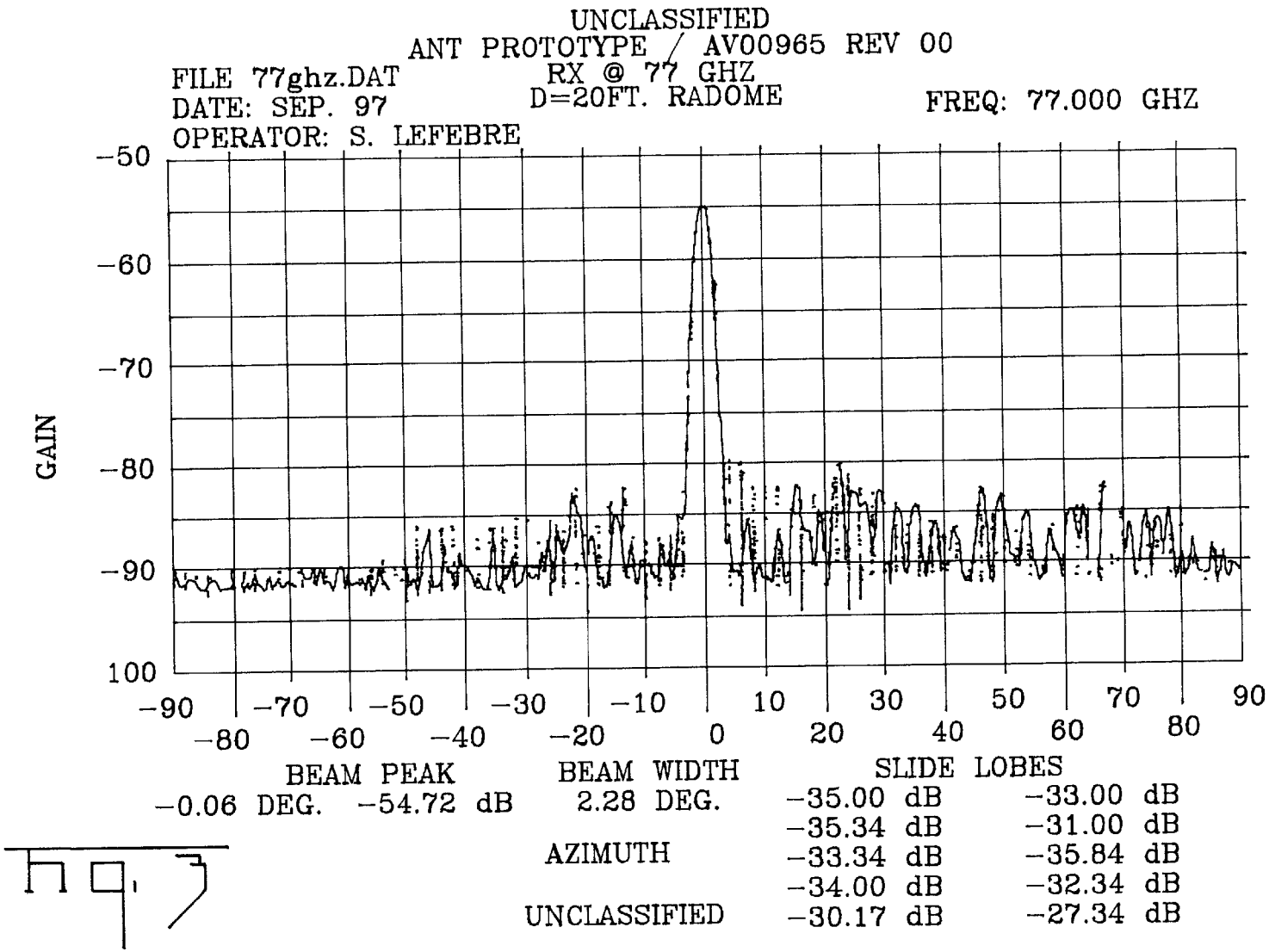

FIG. 2 shows a detail view of a waveguide 20, according to the present invention comprising slots 21 through which a beam is fed to produce a desired phase difference along the antenna array. For each of a plurality of beam inputs to the antenna array, a corresponding waveguide produces a desired phase difference, which accumulates and causes a beam to focus at a desired angle.

FIG. 3 depicts a resultant directional beam in accordance with the present invention for a single input. For a three beam input to the antenna 10 of FIG. 1, the waveguide 11 would be partitioned to comprise three distinct waveguide sections with a slot pattern selected to focus each beam input at a preselected angle.

The present invention is thereby self-phasing and capable of producing directed beams without the use of sophisticated control electronics. Moreover the present invention operates without the use of phase shifters or adaptive controls such as feedback loops and does not require extensive computations to steer a beam.

Although the present invention has been described in considerable detail with reference to certain preferred versions thereof, other versions are possible. Therefore, the spirit and scope of the invention of the appended claims should not be limited to the description of the preferred versions contained herein.

The reader's attention is directed to all papers and documents which are filed concurrently with this specification and which are open to public inspection in conjunction with this specification, and the contents of all such papers and documents are incorporated herein by reference.

All the features disclosed in this specification (including any accompanying claims, abstract and drawings), and/or all of the steps or any method or process so disclosed, may be combined in any combination, except combinations where at least some of the features and/or steps are mutually exclusive.

Each feature disclosed in this specification (including any accompanying claims, abstract, and drawings), may be replaced by alternative features serving the same equivalent or similar purpose, unless expressly stated otherwise. Thus, unless expressly stated otherwise, each feature disclosed is one example only of a generic series of equivalent or similar features.

What is claimed is:

1. An antenna device comprising:

a metal plate;

a waveguide disposed on, and in intimate contact with, an upper surface of said metal plate, said waveguide comprising a plurality of sections having slots disposed therein for guiding a corresponding plurality of electromagnetic waves therethrough;

a common linear patch antenna array disposed on, and in intimate contact with, an upper surface of said waveguide;

a plurality of electrical inputs connected to said waveguide and said linear patch antenna array for feeding said plurality of electromagnetic waves at a predetermined frequency to said waveguide and said linear patch antenna array; and a transmitting and receiving circuit for transmitting said electromagnetic waves to said waveguide and linear patch antenna array and receiving electrical signals from said linear patch antenna array, whereby when said plurality of electromagnetic waves is directed through said plurality of sections of said waveguide, said plurality of waveguide sections generate a plurality of phase differences which accumulate to form a directed beam through said linear patch antenna array.

2. An antenna device as recited in claim 1 wherein said antenna device is substantially planar.

3. An antenna device as recited in claim 1 wherein said waveguide comprises at least three sections.

4. An antenna device as claimed in claim 1 wherein said phase difference accumulates to focus said directed beam at a predetermined angle.

5. An antenna device as claimed in claim 1 wherein said predetermined frequency is 77 GHz.

6. An antenna system comprising:

a common patch antenna array;

a waveguide disposed in intimate contact with said common patch antenna, said waveguide comprising a plurality of sections having slots for guiding electromagnetic waves therethrough, each section being dimensioned relative to each other section to generate phase differences in the electromagnetic waves, which phase differences accumulate and focus to form a directed beam passing through said common patch antenna; and a circuit for generating the electromagnetic waves at a predetermined frequency for (1) transmission through the waveguide and the common patch antenna, and (2) receiving electrical signals through the common patch antenna.

7. The antenna system recited in claim 6 wherein said predetermined frequency is 77 GHz.

8. A method of generating a plurality of directed beams, comprising the steps of:

feeding a plurality of electromagnetic waves through a waveguide, said waveguide having a plurality of sections, each section being dimensioned relative to the other sections to generate phase differences; and accumulating and focusing the phase differences to produce a plurality of directed beams passing through a common patch antenna.

* * * * *